US006142724A

United States Patent [19]

Hirooka et al.

[11] Patent Number: 6,142,724

[45] Date of Patent: Nov. 7, 2000

[54] FRONT LOADER ATTACHING STRUCTURE

[75] Inventors: Masami Hirooka; Koichi Kawaguchi; Naoya Muramoto, all of Sakai, Japan

[73] Assignee: Kubota Corporation, Osaka, Japan

[21] Appl. No.: 09/181,340

[22] Filed: Oct. 29, 1998

[30] Foreign Application Priority Data

Mar. 23, 1998 [JP] Japan ..... 10-074423
Mar. 23, 1998 [JP] Japan ..... 10-074424

[51] Int. Cl.[7] ..... E02F 3/627

[52] U.S. Cl. ..... 414/686; 414/722

[58] Field of Search ..... 414/686, 685, 414/722; 172/272, 274

[56] References Cited

U.S. PATENT DOCUMENTS 4,264,264 4/1981 McMillan et al. ..... 414/686
5,540,289 7/1996 Hirooka et al. ..... 414/686 X
5,620,297 4/1997 Mahaney ..... 414/686

*Primary Examiner*—Donald W. Underwood
*Attorney, Agent, or Firm*—Webb Ziesenheim Logsdon Orkin & Hanson, P.C.

[57] ABSTRACT

Each of right and left attaching units of a front loader of a working vehicle has a pair of side plates extending vertically, and a connecting member interconnecting the side plates in positions intermediate in a fore and aft direction, As a result, each of the right and left attaching units has an H-shaped cross section.

15 Claims, 3 Drawing Sheets

FRONT LOADER ATTACHING STRUCTURE

BACKGROUND OF THE INVENTION

1. Field of the Invention

This invention relates to a front loader of a working vehicle, and more particularly to a front loader attaching structure.

2. Description of the Related Art

A conventional front loader includes attaching units detachably attached to masts disposed at right and left sides of a tractor body, booms extending forward from and vertically pivotably attached to the attaching units, and a working tool vertically pivotably attached to distal ends of the booms. The masts have a U-shaped section opening forward. The attaching units also have a U-shaped section opening forward. The attaching units are inserted into the masts, and receive proximal ends of the booms.

Consequently, the attaching units must have a larger width than the booms, and the masts must have a larger width than the attaching units.

Reinforcing members called braces are provided for the masts to reinforce connections between the masts and attaching units.

That is, in the conventional front loader, each mast not only has an excessively large transverse dimension but requires a brace for reinforcing purposes. Thus, there is room for improvement in terms of cost.

SUMMARY OF THE INVENTION

An object of this invention is to provide a front loader attaching structure different from the conventional structure.

Another object of this invention is to provide a front loader attaching structure not requiring masts to have a large transverse dimension.

The above objects are fulfilled, according to this invention, by a front loader comprising right and left attaching units each having a pair of side plates and a connecting member extending vertically to interconnect the side plates in positions intermediate in a fore and aft direction.

With this construction, each attaching unit defines a space opening forwardly of the connecting member, and a space opening rearwardly thereof. These spaces may be used to receive a boom and a mast, respectively.

Preferably, the connecting member is in form of a plate. Then, each attaching unit has an H-shaped section taken horizontally across the connecting member. This attaching unit has increased strength.

DETAILED DESCRIPTION OF THE PREFERRED EMBODIMENT

An embodiment of this invention will be described hereinafter with reference to the drawings.

Figure 1:
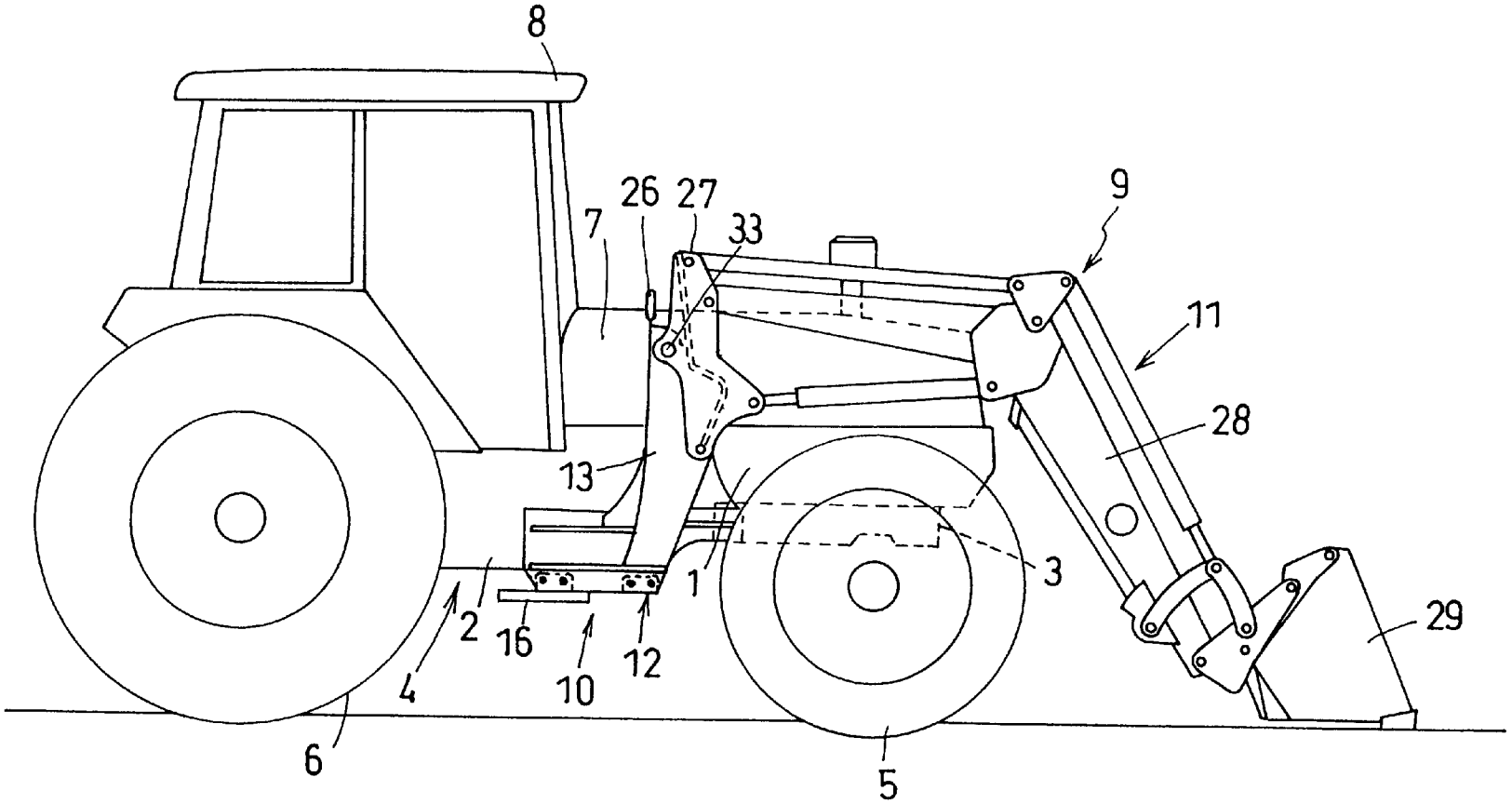
FIG. 1 is a side elevation of a tractor with a front loader attached thereto in accordance with this invention.
Figure 2:
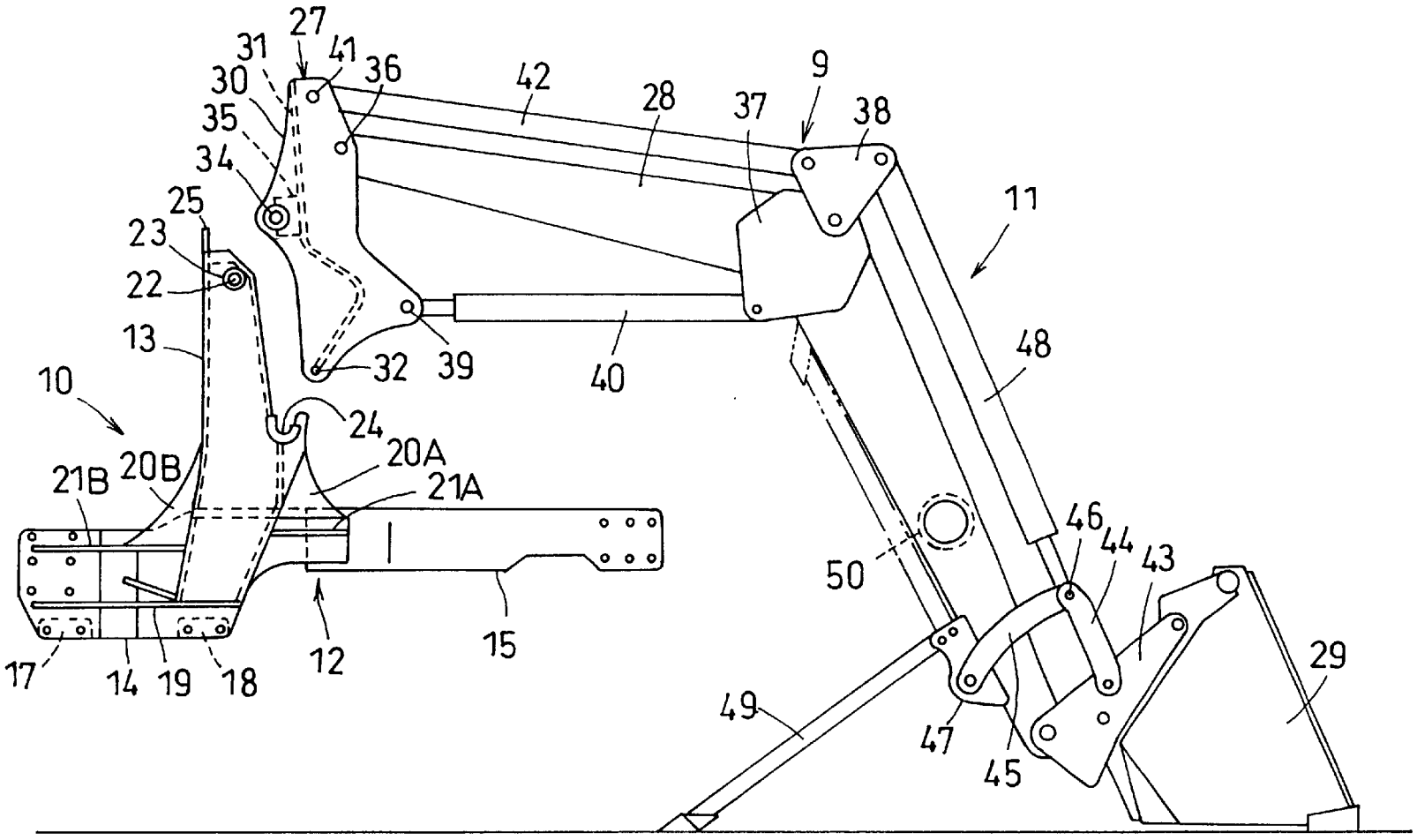
FIG. 2 is a side view of the front loader and a mast according to this invention.

In FIGS. 1 and 2, a tractor includes an engine 1, a transmission case 2, a front axle frame 3 and so on rigidly interconnected to form a vehicle body 4. The vehicle body 4 is supported by front wheels 5 and rear wheels 6. The engine 1 is covered by a hood 7. The vehicle body 4 has a cabin 8 mounted on a rear portion thereof and defining a driving compartment.

In this specification, the term forward always refers to a forward direction with respect to the vehicle body 4, and the term transverse or right and left always refers to a transverse direction with respect to the fore and aft direction of the vehicle body 4.

A front loader 9 is detachably attached to the tractor. The front loader 9 includes a base device 10 fixed to the vehicle body 4, and a coupling device 11 detachably attached to the base device 10.

The base device 10 includes, as main components thereof, support frames 12 fixed to right and left side walls of vehicle body 4, and a pair of right and left masts 13 erected on the support frames 12.

As shown in FIG. 2, each support frame 12 includes a first support frame 14 fixed to a side wall of transmission case 2, and a second support frame 15 fixed to a side wall of front axle frame 3. The first and second support frames 14 and 15 are rigidly welded together. The first support frame 14 has a rear end region thereof fixed to the vehicle body 4 by mounting bolts, while the second support frame 15 has a forward end region thereof fixed to the vehicle body 4 by mounting bolts. The rear end of the first support frame 14 is disposed adjacent a step 16. The forward end of the second support frame 15 extends to a position adjacent the forward end of the front axle frame 3.

The right and left first support frames 14 are rigidly interconnected in lower positions thereof by a first and a second connecting frames 17 and 18 arranged in the fore and aft direction. The rear, first connecting frame 17 is fixed to the bottom of transmission case 2 by bolts.

Each of the first support frames 14 has a support base 19 projecting laterally outwardly from a side surface thereof, and one of the masts 13 is erected on the support base 19. The masts 13 are disposed adjacent and rearwardly of front wheels 5.

Figure 3:
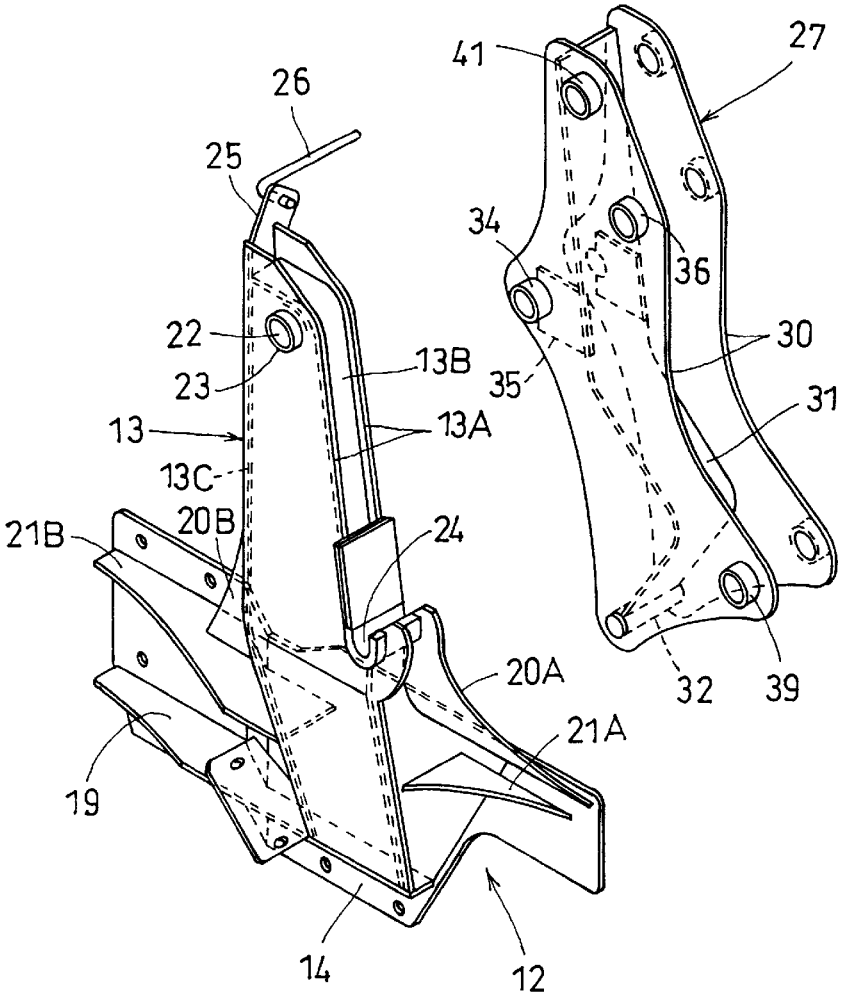
FIG. 3 is a perspective view showing an important part of this invention.

As shown in FIG. 3, each mast 13 has a square cross section with a pair of side faces 13A, a front face 13B and a rear face 13C. Each mast 13 includes, provided for front and rear faces in a lower portion thereof, reinforcing members having fore and aft widths enlarging downwardly. The reinforcing members include a first reinforcing member 20A and a second reinforcing member 20B. The first and second reinforce members 20A and 20B have lower ends thereof welded to overhangs 21A and 21B projecting from the first support frame 14.

Each mast 13 has fixing bores 22 extending transversely through upper positions thereof. Annular coaxial bosses 23 are formed to project right and left from around the fixing bores 22. An upwardly opened engaging recess 24 is disposed below and forwardly of the fixing bores 22.

Each mast 13 has a connecting rod attaching portion 25 disposed at an upper end thereof. A connecting rod 26 extending transversely over the hood 7 is detachably fixed at opposite ends thereof to the attaching portions 25 to interconnect the right and left masts 13.

The coupling device 11 includes attaching units 27 detachably attached to the masts 13, booms 28 pivotally connected to the attaching units 27 to extend forward therefrom, and a working tool 29 pivotally connected to a distal end of boom 28.

Figure 4:
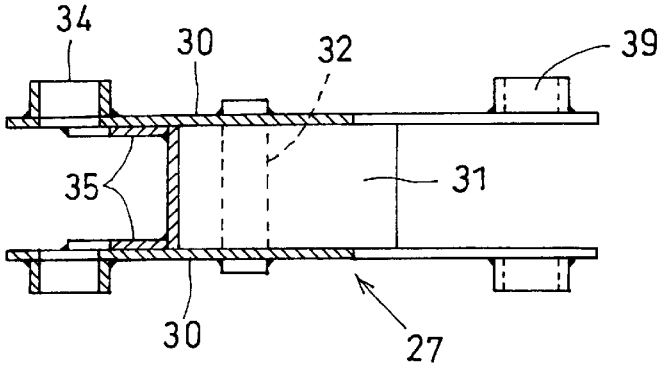
FIG. 4 is a sectional view of a front loader attaching unit according to this invention.

As shown in FIG. 2 and 3, each attaching unit 27 includes a pair of right and left side plates 30, and a connecting member 31 extending vertically and interconnecting positions intermediate in the fore and aft direction of side plates 30. The connecting member 31 is formed of a plate material with opposite sides thereof rigidly welded to the side plates 30. Consequently, as shown in FIG. 4, each attaching unit 27 has an H-shaped cross section. The right and left side plates 30 have opposed surfaces spaced from each other by a greater distance than a transverse width between right and left outer surfaces of mast 13.

The attaching unit 27 has an engaging element 32 formed in a lower position thereof for releasably engaging the engaging recess 24 of mast 13. The engaging element 32 is in the form of a pin disposed between the right and left side plates 30 and having a horizontal axis. This pin 32 engages the engaging recess 24 from above.

The attaching unit 27 has receiving bores 34 extending transversely through vertically intermediate and rearward positions thereof for aligning with the fixing bores 22 of mast 13 and removably receiving a fixing member 33. A positioning plate 35 is fixed to inner surfaces of right and left side plates 30 for contacting the annular bosses 23 of mast 13. The receiving bores 34 and fixing bores 22 are aligned when the engaging piece 32 engages the engaging recess 24 and the positioning plate 35 contacts the annular bosses 23. Then, the pin acting as the fixing element 33 is inserted through the fixing bores 22 and receiving bores 34, thereby fixing the attaching unit 27 to the mast 13.

The attaching unit 27 includes a boom pivot portion 36 disposed in a forward position thereof. One of the booms 28 is vertically pivotably connected at a proximal end thereof to the boom pivot portion 36. Each boom 28 is bent, and a reinforcing plate 37 is disposed in a bent position thereof. A triangular plate 38 is attached to an upper position of the reinforcing plate 37 to be pivotable about a horizontal axis.

As shown in FIG. 2, the attaching unit 27 includes a boom cylinder pivot portion 39 disposed in a forward position thereof below the boom pivot portion 36. A boom cylinder 40 extends between the boom cylinder pivot portion 39 and a lower position of reinforcing plate 37. The boom 28 is vertically movable with extension and retraction of the boom cylinder 40. The attaching unit 27 further includes a link pivot portion 41 formed in an upper position thereof above the boom pivot portion 36. One of parallel links 42 interconnects the link pivot portion 41 and a rear position of triangular plate 38.

A first arm 43 is vertically pivotably connected to the distal end of boom 28. The working tool 29 is attached to the first arm 43. The working tool 29 is exemplified by a bucket. A second arm 44 is connected to and extends rearward from the first arm 43 to be pivotable about a horizontal axis. A third arm 45 is connected to the rear end of the second arm 44 through a support axis 46. The third arm 45 is connected at a lower end thereof, to be pivotable about a horizontal axis, to a stand mounting bracket 47 secured to a lower surface at the distal end of boom 28. A working tool actuating cylinder 48 is mounted between the support axis 46 and a forward position of triangular plate 38. The working tool 29 at the distal end is vertically pivotable with extension and retraction of cylinder 48.

A stand 49 is pivotally attached to the stand mounting brackets 47. The stand 49 is retracted, during an earth-moving operation, to a contained position along lower surfaces of booms 28 as shown in phantom lines in FIG. 2. When the coupling device is detached, the stand 49 is used as shown in solid lines.

The right and left booms 28 are interconnected by a connecting pipe 50.

In the attaching unit 27 having the above construction, the connecting member 31 extends at least between the engaging piece 32 and receiving bores 34. In this embodiment, the connecting member 31 extends from upper ends of the side plates 30 to the pin acting as the engaging piece 32, and is welded to the pin 32.

The side plates 30, as seen from a side thereof, have a profile with recesses from one axis to another of the engaging piece 32, receiving bores 34, boom pivot portion 36 and boom cylinder pivot-portion 39. That is, the regions of boom cylinder pivot portion 39 of side plates 30 protrude forwardly of the boom pivot portion 36. The regions of receiving bores 34 of side plates 30 protrude rearwardly of other parts of side plates 30.

The connecting member 31 is curved to follow this profile of the side plates 30. Specifically, the part of connecting member 31 corresponding to the region of boom cylinder pivot portion 39 protrudes forwardly of the other parts of the connecting member 31.

According to the embodiment of this invention having the above construction, each attaching unit 27 has an H-shaped cross section, and the side plates 30 thereof have a profile defining curved recesses. Compared with a known rigid, box-shaped attaching unit, this attaching unit 27 is elastically deformable with ease by a load applied from the boom 28, to assure a good stress distribution. Each mast 13, with a closed, box-like section, may have increased strength despite a reduced transverse dimension. The braces used in the prior art are dispensed with since the lower portions of the masts are reinforced by the reinforcing members having a fore and aft width increasing downwardly. The support frames with the forward ends thereof extending to positions adjacent the forward end of the front axle frame serve as reinforcing frames with sufficient effect.

Since the conventional braces are no longer needed, a side plate of the hood may be opened and closed with ease to facilitate maintenance of the hood interior.

This invention is not limited to the foregoing embodiment, but the technical scope of this invention includes equivalents of the embodiment described herein.

What is claimed is:

1. A front loader attachable to masts disposed at right and left sides of a tractor, said front loader comprising:

a pair of right and left attaching units each having a pair of side plates, said side plates being interconnected in positions intermediate in a fore and aft direction by a connecting member extending vertically;

booms pivotably supported by said attaching units, respectively; and a working tool pivotably connected to said booms, wherein said connecting member is a plate, and wherein each of said attaching units has an H-shaped cross section.

2. A front loader as defined in claim 1, wherein each said pair of side plates include a boom pivot portion for supporting one of said booms, and a boom cylinder pivot portion for supporting a boom cylinder for driving said one of said booms, said side plates having regions of said boom cylinder pivot portion protruding forwardly of said boom pivot portion.

3. A front loader as defined in claim 2, wherein said connecting member includes a part corresponding said region of said boom cylinder pivot portion, said part protruding forwardly of other parts of said connecting member.

4. A front loader as defined in claim 2, wherein said pair of side plates include receiving bores for engagement with one of said masts, and an engaging piece disposed adjacent lower ends of said side plates, said connecting member extending at least from regions of said receiving bores to a region of said engaging piece.

5. A front loader as defined in claim 4, wherein said regions of said receiving bores protrude rearwardly of other parts of said side plates.

6. A tractor comprising:

a vehicle body;

a pair of masts disposed at right and left sides of said vehicle body; and a front loader attachable to said pair of masts, said front loader including:

a pair of right and left attaching units corresponding to said pair of masts, each of said attaching units having a pair of side plates, said side plates being interconnected in positions intermediate in a fore and aft direction by a connecting member extending vertically;

booms pivotably supported by said attaching units, respectively; and a working tool pivotably connected to said booms, wherein said connecting member is a plate, and wherein each of said attaching units has an H-shaped cross section.

7. A tractor as defined in claim 6, wherein each of said masts has a pair of mast sides, said side plates of each of said attaching units holding said mast sides therebetween when attached to one of said masts.

8. A tractor as defined in claim 7, wherein each of said masts has a front face and a rear face interconnecting said pair of mast sides, thereby defining a square section.

9. A tractor as defined in claim 6, wherein said pair of masts are interconnected in upper positions thereof by a connecting rod.

10. A tractor as defined in claim 6, wherein each of said masts includes, arranged in a lower position thereof, a support frame attached laterally of said vehicle body, and a reinforcing member extending between lower portions of each of said masts, said reinforcing member being shaped to have a fore and aft width enlarging downwardly.

11. A tractor as defined in claim 10, wherein said reinforcing member is welded to a lower forward and rearward surface of each of said masts, said vehicle body having a front axle frame for supporting front axles, said support frame having a forward end thereof extending to a side surface of said front axle frame.

12. A front loader as defined in claim 6, wherein said pair of side plates include a boom pivot portion for supporting one of said booms, and a boom cylinder pivot portion for supporting a boom cylinder for driving said one of said booms, said side plates having regions of said boom cylinder pivot portion protruding forwardly of said boom pivot portion.

13. A front loader as defined in claim 12, wherein said connecting member includes a part corresponding to said region of said boom cylinder pivot portion, said part protruding forwardly of other parts of said connecting member.

14. A front loader as defined in claim 6, wherein said pair of side plates include receiving bores for engagement with one of said masts, and an engaging piece disposed adjacent lower ends of said side plates, said connecting member extending at least from regions of said receiving bores to a region of said engaging piece.

15. A front loader as defined in claim 14, wherein said regions of said receiving bores protrude rearwardly of other parts of said side plates.

* * * * *